US005891516A

United States Patent [19]

Gstrein et al.

[11] Patent Number: 5,891,516

[45] Date of Patent: Apr. 6, 1999

[54] FABRIC FOR FORMING FIBER CEMENT ARTICLES

[75] Inventors: Hippolit Gstrein, Gloggnitz; Oswald Breit, Wien, both of Austria

[73] Assignee: Weavexx Corporation, Wake Forest, N.C.

[21] Appl. No.: 96,940

[22] Filed: Jun. 12, 1998

[51] Int. Cl.[6] ..... B05D 3/00

[52] U.S. Cl. ..... 427/189; 427/190; 427/372.2; 442/203; 442/268; 442/270; 442/277; 442/320; 442/326

[58] Field of Search ..... 428/198, 234; 442/203, 268, 270, 277; 162/358, 359, 900, 904, 901, 902; 427/189, 190, 272.2, 372.2

[56] References Cited

U.S. PATENT DOCUMENTS

| | | |
|---|---|---|
| 4,077,577 | 3/1978 | Wright . |
| 4,306,911 | 12/1981 | Gordon . |
| 4,356,225 | 10/1982 | Dufour . |
| 4,369,218 | 1/1983 | Mazere . |
| 4,461,803 | 7/1984 | Booth . |
| 4,467,839 | 8/1984 | Westhead . |
| 4,495,235 | 1/1985 | Tesch . |
| 4,500,588 | 2/1985 | Lundstrom . |
| 4,503,113 | 3/1985 | Smart . |
| 4,772,328 | 9/1988 | Pfeifer . |
| 5,110,672 | 5/1992 | Zehle . |
| 5,143,684 | 9/1992 | Stein . |
| 5,204,171 | 4/1993 | Eschmann . |
| 5,225,269 | 7/1993 | Bohlin . |
| 5,277,967 | 1/1994 | Zehle . |
| 5,308,673 | 5/1994 | Tochacek . |
| 5,368,696 | 11/1994 | Cunnane, III . |
| 5,372,876 | 12/1994 | Johnson . |
| 5,482,756 | 1/1996 | Berger . |
| 5,549,967 | 8/1996 | Gstrein . |
| 5,731,063 | 3/1998 | Schultz . |
| 5,785,818 | 7/1998 | Fekete . |
| 5,787,936 | 8/1998 | Snipes . |

*Primary Examiner*—Jenna Davis
*Assistant Examiner*—Arti R. Singh
*Attorney, Agent, or Firm*—Myers, Bigel, Sibley & Sajovec

[57] ABSTRACT

Fiber cement felts of the present invention include: a top fabric layer that includes fine machine direction yarns and fine cross machine direction yarns interwoven with the fine machine direction yarns; a bottom fabric layer underlying the top fabric layer that includes coarse machine direction yarns and coarse cross machine direction yarns interwoven with the coarse machine direction yarns; and a batt layer attached to and overlying the top fabric layer. Preferably, the top fabric layer is heat bonded to the bottom fabric layer. It is also preferred that the fiber cement felt of the present invention include a second batt layer that underlies the bottom fabric layer. In this multiple layer structure, the felt can have higher tenacity, improved resistance to blinding and compaction, and a reduced tendency to mark a fiber cement sheet during its formation.

11 Claims, 2 Drawing Sheets

FABRIC FOR FORMING FIBER CEMENT ARTICLES

FIELD OF THE INVENTION

The present invention relates generally to fabrics, and more particularly to fabrics employed to form articles of fiber cement.

BACKGROUND OF THE INVENTION

Fiber cement is a well-known material employed in many building materials, such as siding, roofing and interior components, as well as pipes, particularly for waste water transport. Fiber cement typically comprises a mixture of cement (i.e., lime, silica and alumina), clay, a thickener, inorganic fillers such as calcium carbonate, and one or more fibrous materials. In the past, asbestos was commonly included as the fibrous material (see U.S. Pat. No. 4,216,043 to Gazzard et al.); because of the well-documented problems asbestos presents, now fiber cement typically includes a natural or synthetic fiber, such as acrylic, aramid, polyvinyl alcohol, polypropylene, cellulose or cotton. Fiber cement is popular for the aforementioned applications because of its combination of strength, rigidity, impact resistance, hydrolytic stability, and low thermal expansion/contraction coefficient.

To be used in siding or roofing components, fiber cement is often formed in sheets or tubes that can be used "as is" or later cut or otherwise fashioned into a desired shape. One technique of forming fiber cement articles (known as the Hatschek process) involves creating an aqueous fiber cement slurry of the components described above, depositing the slurry as a thin sheet or web on a porous fabric belt, and conveying the slurry over and through a series of rollers to flatten and shape the slurry. As the slurry is conveyed, moisture contained therein drains through openings in the fabric. Moisture removal is typically augmented by the application of vacuum to the slurry through the fabric (usually via a suction box located beneath the porous fabric). After passing through a set of press rolls, the fiber cement web can be dried and cut into individual sheets, collected on a collection cylinder for subsequent unrolling and cutting into individual sheets, or collected as a series of overlying layers on a collecting cylinder that ultimately forms a fiber cement tube.

The porous fabric used to support the slurry as moisture is removed is typically woven from very coarse (between about 2500 and 3000 dtex) polyamide yarns. Most commonly, the yarns are woven in a "plain weave" pattern, although other patterns, such as twills and satins, have also been used. Once they are woven, the yarns are covered on the "sheet side" of the fabric (i.e., the side of the fabric that contacts the fiber cement slurry) with a batt layer; on some occasions, the "machine side" of the fabric (i.e., the side of the fabric that does not contact the slurry directly) is also covered with a batt layer. The batt layer assists in the "pick-up" of the slurry from a vat or other container for processing. Because of the presence of the batt layer(s), the fabric is typically referred to as a fiber cement "felt."

Coarse yarns have been employed in fiber cement felts because of the severe conditions the felt experiences during processing. For example, fiber cement felts are typically exposed to high load conditions by the forming machine. Also, there can be significant variations in tension over the felt length on the fiber cement machine, as tension may vary from as low as 2 kilopounds/cm after the forming roll to as high as 15 kilopounds/cm over suction boxes. As a result, coarse yarns having high "tenacity" and resilience have been employed. However, because the yarns are coarse, such felts have a tendency to mark the surface of the fiber cement product formed thereon, sometimes to a sufficient degree that smoothing of the surface in a subsequent operation may be required. Further, fiber cement felts are prone to "blinding" (the filling of the openings in the fabric mesh with fiber cement slurry) and typically must be cleaned frequently and may be removed (depending on machine conditions such as speed and load) after as little as one week. Also, such felts tend to suffer significant "compaction" (the tendency of the felt to decrease in thickness) with use. Compaction is detrimental to operation in that, as the felt decreases in thickness, the pressure exerted on the fiber cement by the pressing rolls can decrease, thereby altering the surface characteristics as well as overall physical properties of the sheet. Also, some compaction may be localized, with the result that the fiber cement can have areas of different thickness. Accordingly, compacted felts are typically replaced.

SUMMARY OF THE INVENTION

In view of the foregoing, it is an object of the present invention to provide a fiber cement felt that produces a fiber cement article with decreased marking.

It is also an object of the present invention to provide a fiber cement felt that resists compaction.

It is another object of the present invention to provide a fiber cement felt that is less prone to blinding.

It is an additional object of the present invention to provide a fiber cement felt with high tenacity (for example, as high as 150 kilonewtons per centimeter).

It is a further object of the present invention to provide a method for producing such a fiber cement felt.

It is a still further object of the present invention to provide a method for producing fiber cement with reduced marking.

These and other objects are satisfied by the present invention, which is directed to a fiber cement felt structure that includes a top fabric layer comprising fine yarns. More specifically, the fiber cement felts of the present invention include: a top fabric layer that includes fine machine direction yarns and fine cross machine direction yarns interwoven with the fine machine direction yarns; a bottom fabric layer underlying the top fabric layer that includes coarse machine direction yarns and coarse cross machine direction yarns interwoven with the coarse machine direction yarns; and a batt layer attached to and overlying the top fabric layer. Preferably, the top fabric layer is heat bonded to the bottom fabric layer. It is also preferred that the fiber cement felt of the present invention include a second batt layer that underlies the bottom fabric layer. In this multiple layer structure, the felt can have higher tenacity, improved resistance to blinding and compaction, and a reduced tendency to mark a fiber cement sheet during its formation.

The fiber cement felt of the present invention can be used in typical fiber cement forming processes. As such, another aspect of the present invention is a method of forming a fiber cement article with a fiber cement felt. The steps of the method include: providing a fiber cement felt as described hereinabove; depositing a fiber cement slurry on the fiber cement felt; and removing moisture from the fiber cement slurry. In this manner, articles such as fiber cement sheet and pipe can be prepared.

DETAILED DESCRIPTION OF THE PREFERRED EMBODIMENT

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
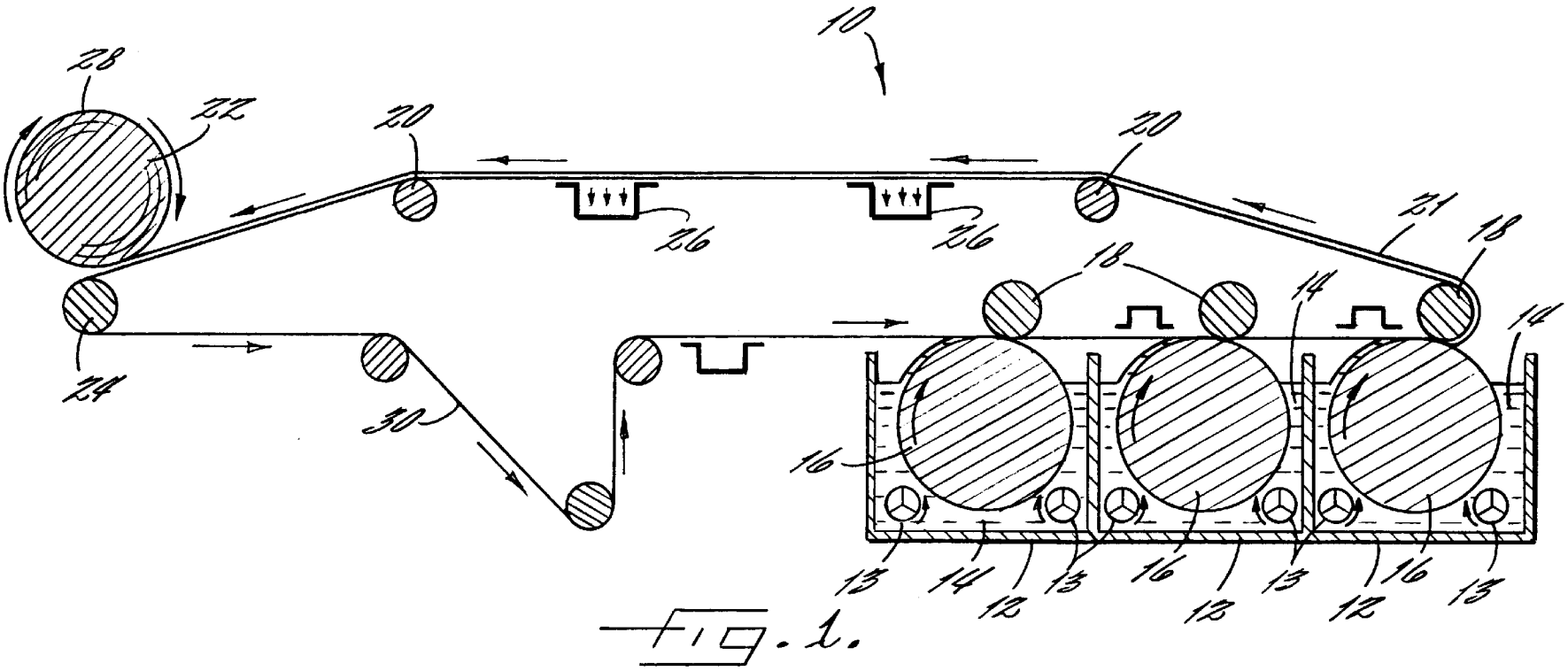
FIG. 1 is a schematic illustration of a fiber cement forming apparatus of the present invention.

Referring now to FIG. 1, a fiber cement forming apparatus, designated broadly at 10, is illustrated therein. The forming apparatus 10, which performs a typical Hatschek process, generally includes an endless fiber cement felt 30 positioned in rolling contact with and driven by a number of guide rolls 20. Beginning in the lower right comer of FIG. 1, the felt 30 passes above three vats 12, each of which contains a batch of fiber cement slurry 14. As used herein, "fiber cement" means any cementitious composition including cement, silica, and fiber for reinforcement, including asbestos, polyvinyl alcohol, polypropylene, cotton, wood or other cellulosic material, acrylic, and aramid. It is contemplated that other materials such as thickeners, clays, pigments, and the like, that impart desirable processing or performance characteristics to the fiber cement slurry 14 or an article formed therefrom may also be included. Each vat 12 is positioned below a deposition cylinder 16 mated with a couch roll 18. Each vat 12 also includes an agitator 13 which prevents the fiber cement slurry 14 from solidifying therein.

Rotation of each deposition cylinder 16 collects fiber cement slurry 14 on the cylinder's surface; as the felt 30 travels over and contacts the cylinder 16, the slurry 14 is transferred from the cylinder 16 to the felt 30. The amount of slurry 14 deposited on the fabric 30 by each cylinder 16 is controlled by the corresponding couch roll 18. Preferably, the fiber cement slurry 14 is deposited as a web 21 at a thickness of between about 0.3 mm and 3 mm.

Still referring to FIG. 1, once the fiber cement slurry web 21 has been collected on the felt 30 from each of the vats 12, the felt 30 conveys the slurry web 21 over one guide roll 20, then over one or more suction boxes 26 (two are shown in FIG. 1), each of which applies negative pressure to the felt 30, thereby encouraging the removal of moisture from the slurry web 21. Finally, the felt 30 and the slurry web 21 pass over a second guide roll 20, then between the nip formed by a breast roll 24 and a forming roll 22. After passing through the nip, the slurry web 21 has formed into a semi-solid fiber cement sheet 28 that is collected on the surface of the forming roll 22.

Those skilled in this art will recognize that other forming apparatus are also suitable for use with the fiber cement felts of the present invention. For example, felts of the present invention can also be used to form fiber cement pipe. In such an operation, the fiber cement sheet 28 can be collected in contacting layers on a forming roll; as they dry, the overlying layers form a unitary laminated tube. Often, a pipe forming apparatus will include small couch rolls that act in concert with the forming roll to improve interlaminar strength. Also, a second felt may travel over the additional couch rolls to assist in water absorption and finishing.

Figure 2:
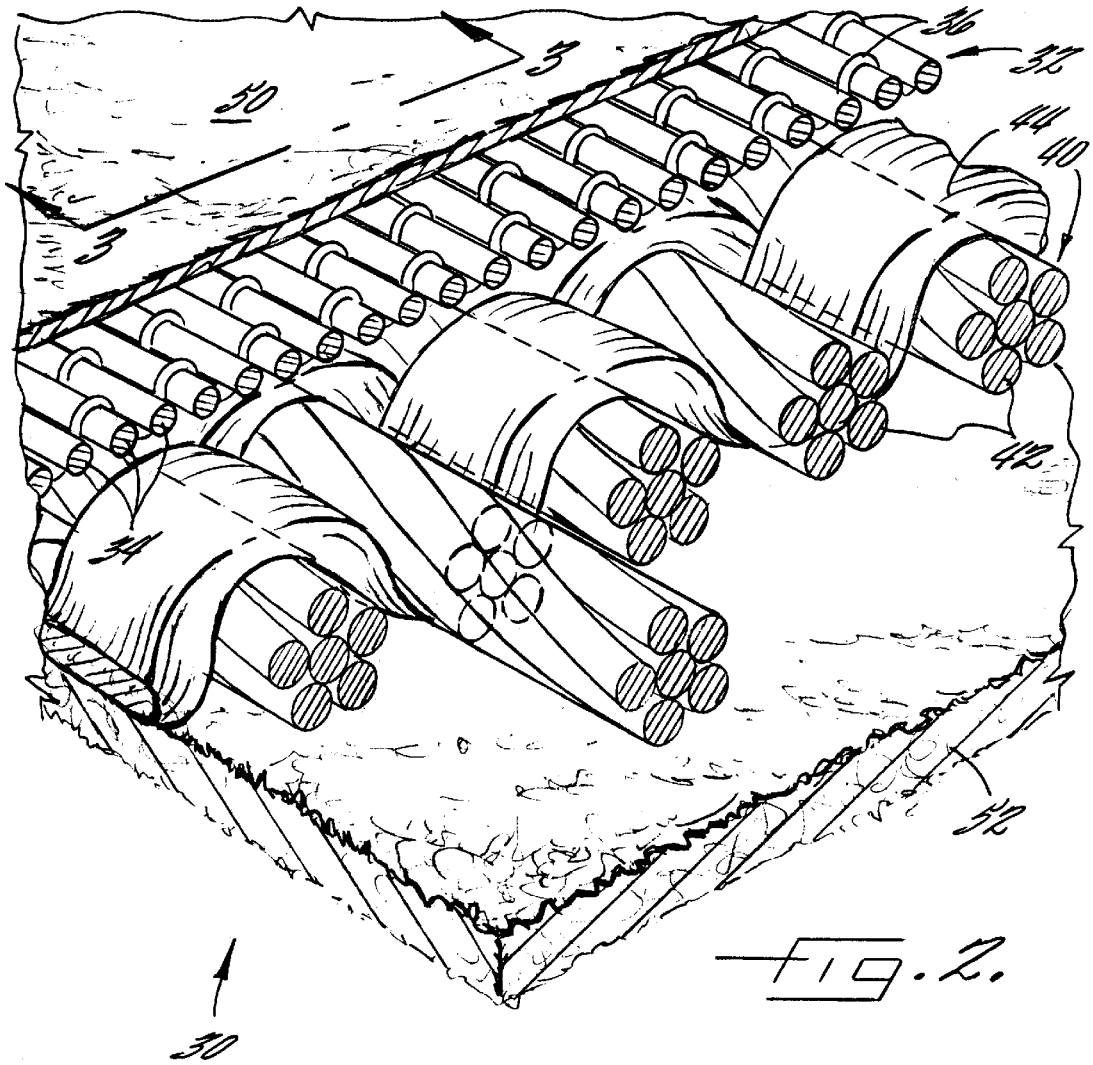
FIG. 2 is an enlarged cutaway perspective view of the fabric and batt layers of the fiber cement felt of FIG. 1.
Figure 3:
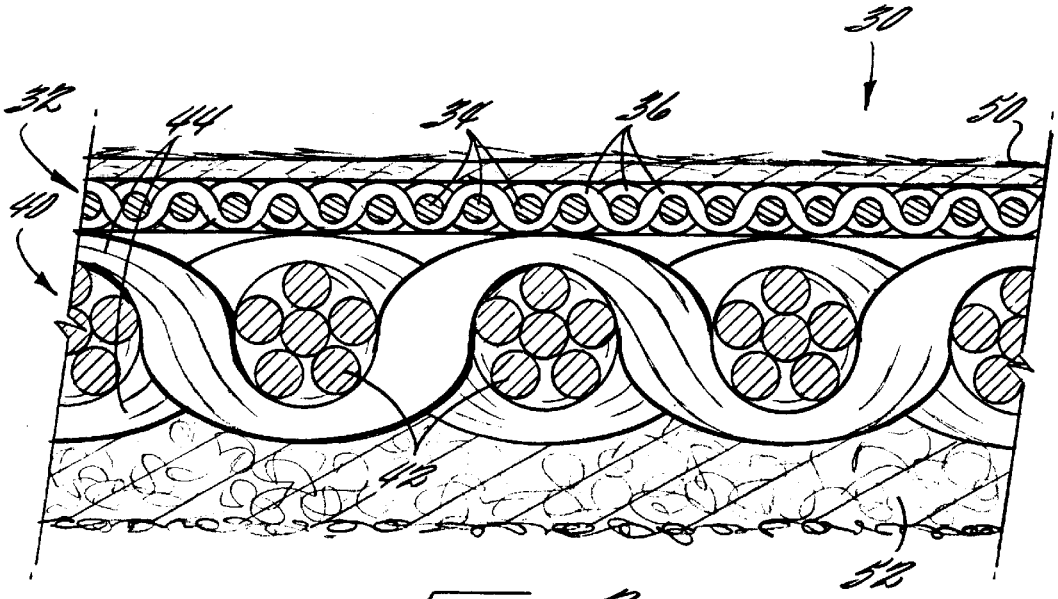
FIG. 3 is a section view of the fiber cement felt of FIG. 2 taken in the cross machine direction.

The configuration of the felt 30 can be best understood by reference to FIGS. 2 and 3. As illustrated in FIG. 2, the felt 30 includes two distinct fabric layers: a top fabric layer 32 and a bottom fabric layer 40. The felt 30 also includes a batt layer 50 that overlies the top fabric layer 32 and a bottom batt layer 52 that underlies the bottom fabric layer 40. These layers are described in greater detail below.

Referring again to FIGS. 2 and 3, the top fabric layer 32 is illustratively and preferably a plain weave fabric comprising interlaced machine direction yarns 34 and cross machine direction yarns 36. As used herein, the term "machine direction" refers to the direction the felt 30 travels on the fiber cement apparatus 10, and the term "cross machine direction" refers to the direction perpendicular to the machine direction and parallel to the plane defined by the felt 30. The yarns comprising the top layer 32 are fine yarns which can reduce the tendency of the felt 30 to cause marking on the fiber cement sheet 28 formed thereon. Reduced sheet marking can result from processing with a finely woven mesh because the close proximity of the fine yarns to one another can support both ends of fibers within the fiber cement rather than allowing one end of a fiber to reside with the gap between yarns, as can happen with a coarser mesh. Preferably, the machine direction yarns 34 are somewhat coarser than the cross machine direction yarns 36; the machine direction yarns 34 can range in fineness from 500, 300, or even 250 tex to 1000, 1500, or even 2500 tex. The cross machine direction yarns 36 can range in fineness from 250, 100, or even 35 tex to 600, 1000, or even 2000 tex. As used herein, "tex" refers to the well-known unit of fineness used to describe textile yarns, in which the number of tex is equal to the mass in grams of a 1000 meter length of yarn. An exemplary top fabric layer 32 comprises 1000 tex machine direction yarns and 600 tex cross machine direction yarns. Those skilled in this art will recognize that fabric patterns other than a plain weave, such as a 1×2, 1×3, or 1×4 twill, a satin, or other weave pattern known to those skilled in this art, can also be used in the top layer 32 of the present invention.

The form of the yarns utilized in the top fabric layer 32 can vary, depending upon the desired properties of the felt 30. For example, the yarns may be multifilament yarns, monofilament yarns, twisted multifilament or monofilament yarns, spun yarns, core-wrapped yarns, or any twists or other combination thereof. It is preferred that the machine direction yarns 34 and the cross machine direction yarns 36 be twists of multifilaments and spun yarns. Also, the materials comprising yarns employed in the fabric of the present invention may be those commonly used in papermakers' fabric. For example, the yarns 34, 36 may be formed of cotton, wool, polypropylene, polyester, aramid, polyamide, or the like, with polyamide yarns being preferred for both the machine direction yarns 34 and the cross machine direction yarns 36. Of course, the skilled artisan should select yarn materials according to the parameters of the fiber cement forming process.

Still referring to FIGS. 2 and 3, the bottom fabric layer 40 also comprises a plain weave fabric comprising interwoven machine direction yarns 42 and cross machine direction yarns 44. Both the machine direction yarns 42 and cross machine direction yarns 44 are coarse yarns, with the machine direction yarns 42 being more coarse than the cross machine direction yarns 44. The machine direction yarns 42 can be between about 1000 tex and 3500 tex in fineness, and the cross machine direction yarns can be between about 600 tex and 2500 tex in fineness. An exemplary bottom fabric layer 40 comprises 2000 tex machine direction yarns and 1000 tex cross machine direction yarns. The discussion hereinabove regarding the yarn materials of the top fabric layer 32 is equally applicable to the bottom fabric layer 40; thus, it is preferred that the machine direction yarns 42 and the cross machine direction yarns 44 be twists of multifilament and spun yarns, and that they be formed of polyamide. Also, although the illustrated plain weave pattern is preferred, other weaves, such as the twills and satins discussed above, can also be employed in the bottom fabric layer 40.

Notably, both the top and bottom fabric layers 32, 40 are illustrated as "single layer" fabrics, i.e., they include single sets of machine direction yarns and cross machine direction yarns. However, it is contemplated for the present invention that either or both of the top and bottom fabric layers 32, 40 may be "double layer" fabrics (i.e., they may include top and bottom sets of machine direction yarns interwoven and bound with a set of cross machine direction yarns) or "triple layer" fabrics (i.e., they have top and bottom sets of interwoven machine direction yarns and cross machine direction yarns). Also, for certain applications, the top and bottom fabric layers 32, 40 may exchange positions.

As indicated in FIG. 3, the top fabric layer 32 and bottom fabric layer 40 are attached to one another to prevent relative lateral movement therebetween. It is preferred that, as illustrated in FIG. 3, the top fabric layer 32 be heat bonded to the bottom fabric layer 40, although they can also be attached through needling or other known fastening methods. If the top and bottom fabric layers 32, 40 are heat bonded, they should be woven with yarns, such as polyamide yarns, that form strong, stable heat bonds with one another, and the heat bonding process should be carried out at a temperature and for a time sufficient to create a strong bond between the top and bottom fabric layers 32, 40. For example, if the yarns of the top and bottom fabric layers 32, 40 are polyamide, the heat bonding should occur at between about 100° C. and 250° C. for about 30 minutes.

Referring still to FIGS. 2 and 3, the top batt layer 50 overlies the top fabric layer 32, and the bottom batt layer 52 underlies the bottom fabric layer 40. The batt layers 50, 52 are included to assist in the take-up of fiber cement slurry 14 from the vats 12. The batt layers 50, 52 are typically attached by needling, but can be attached to the top and bottom fabric layers 32, 40 by other methods known to those skilled in this art.

The batt layers 50, 52 should be formed of material, such as a synthetic fiber like acrylic ananeid, polyester, or polyamide, or a natural fiber such as wool, that assists in taking up fiber cement slurry 14 from the vats 12 to form the fiber cement web 21. Preferred materials include polyamide, polyester and blends thereof. The weight of the batt layers 50, 52 can vary, although it is preferably that the ratio of batt weight to fabric weight is about between about 1.0 and 2.0 with 1.5 being more preferred. Also, in some embodiments, it may be desirable to omit the bottom batt layer 52.

In this laminated configuration, fiber cement felts of the present invention can considerably reduce the tendency for fiber cement formed thereon to exhibit marking. Also, the presence of the fine yarns in a high density mesh can increase the tenacity of the felt. In addition, the laminated structure can reduce compaction of fiber cement felts, thereby increasing service life. Moreover, the thermal bonding of the top and bottom fabric layers can provide a polymer matrix of relatively high elasticity within the felt; this high elasticity matrix can provide a "pumping" effect within the felt that draws fiber cement slurry to the batt layers. As a result, the fabric layers are less prone to "blinding", and the felt may require cleaning less frequently.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein. In the claims, means-plus-function clauses are intended to cover the structures described herein as performing the recited function and not only structural equivalents but also equivalent structures.

That which is claimed is:

1. A method of forming a fiber cement article, comprising the steps of:

providing a fiber cement felt, said fiber cement felt comprising: a top fabric layer including fine machine direction yarns and fine cross machine direction yarns interwoven with said fine machine direction yarns;

a bottom fabric layer underlying and attached to said top fabric layer and including coarse machine direction yarns and coarse cross machine direction yarns interwoven with said coarse machine direction yarns; and a batt layer attached to and overlying said top fabric layer;

depositing a fiber cement slurry on said fiber cement felt; and removing moisture from said slurry.

2. The method defined in claim 1, wherein said machine direction yarns of said top fabric layer have a fineness of between about 250 and 2500 tex, and said cross machine direction yarns of said top fabric layer have a fineness of between about 35 and 2000 tex.

3. The method defined in claim 1, wherein said machine direction yarns of said bottom fabric layer have a fineness of between about 1000 and 3500 tex, and said cross machine direction yarns of said bottom fabric layer have a fineness of between about 600 and 2500 tex.

4. The method defined in claim 1, wherein said machine direction yarns and said cross machine direction yarns of said top fabric layer are interwoven in a plain weave pattern.

5. The method defined in claim 1, wherein said machine direction yarns and said cross machine direction yarns of said bottom fabric layer are interwoven in a plain weave pattern.

6. The method defined in claim 1, wherein said batt layer is needled to said top fabric layer.

7. The method defined in claim 1, further comprising a lower batt layer underlying said bottom fabric layer.

8. The method defined in claim 1, wherein said batt layer has a first weight, and said top and bottom fabric layers together have a second weight, and said first weight is between about 100 and 150 percent of said second weight.

9. The method defined in claim 1, wherein said machine direction yarns and said cross machine direction yarns of said bottom fabric layer are multifilament yarns.

10. The method defined in claim 1, wherein said machine direction yarns and said cross machine direction yarns of said bottom fabric layer are spun yarns.

11. The method defined in claim 1, wherein said top fabric layer is heat bonded to said bottom fabric layer.

* * * * *